United States Patent [19]

Kolm et al.

[11] Patent Number: 4,508,994

[45] Date of Patent: Apr. 2, 1985

[54] HEAT-SENSITIVE VARIABLE-RESISTANCE LIGHT SOCKET INSERT

[75] Inventors: Henry H. Kolm, Wayland; Eric A. Kolm, Brookline, both of Mass.

[73] Assignee: Piezo Electric Products, Inc., Cambridge, Mass.

[21] Appl. No.: 480,346

[22] Filed: Mar. 30, 1983

[51] Int. Cl.[3] ..... H05B 37/00

[52] U.S. Cl. ..... 315/200 R; 315/71; 315/205; 315/309; 338/219

[58] Field of Search ..... 315/71, 205, 32, 200 R, 315/309; 338/219

[56] References Cited

U.S. PATENT DOCUMENTS

| | | | |
|---|---|---|---|
| 2,081,801 | 5/1937 | Dunkel | 315/309 |
| 2,726,304 | 12/1955 | Gribble | 338/219 |
| 3,333,224 | 7/1967 | Rosenblatt | 338/219 |
| 3,467,937 | 9/1969 | Norton | 315/71 |
| 4,229,680 | 10/1980 | Berlin et al. | 315/200 R |
| 4,393,299 | 7/1983 | McWilliams | 338/219 |
| 4,435,671 | 3/1984 | Wouk | 315/71 |

*Primary Examiner*—Harold Dixon

*Attorney, Agent, or Firm*—Joseph S. Iandiorio; William E. Noonan

[57] ABSTRACT

A heat-sensitive variable-resistance insert device for use with a light bulb and socket including: a thin, heat-sensitive variable-resistance wafer and a perimetrical insulation member surrounding the edge of the wafer and electrically insulating it from the wall of the socket. The wafer has a contact area on one side for engaging the central contact of the socket and on the other side thereof for engaging the central contact of the light bulb, and an adhesive paste on that other side within the perimetrical member for adhering the device to the base of a light bulb.

21 Claims, 8 Drawing Figures

HEAT-SENSITIVE VARIABLE-RESISTANCE LIGHT SOCKET INSERT

FIELD OF INVENTION

This invention relates to a heat-sensitive variable-resistance insert device for use with a light bulb and socket.

BACKGROUND OF INVENTION

When an electric light bulb is turned on, a sudden incoming surge of electrical current encounters the relatively low resistance (e.g. 3 ohms) typically exhibited by the cold bulb filament. The resistance of the filament may be only 1/41 that of its resistance at operating temperature (e.g. 125 ohms), and in such a case the initial current surge is forty-one times that of the operating current. Consequently, a weak or worn filament will often burn out at the moment the bulb is turned on. To remedy this problem and extend light bulb life, various lamp socket insert devices have been provided. These devices typically employ a variable-resistance thermistor, having contact means on either side thereof, which is interposed between the light socket and bulb contacts. When it is cold (e.g. when the electricity is turned off), the insert device exhibits a resistance which is typically higher than the normal operating resistance of the bulb filament. Accordingly, when the light bulb is turned on the initial current surge through the filament is reduced. As the insert device is heated by the current, its resistance drops so that an increased operating current is delivered to the filament. Simultaneously, the filament has typically attained an operating resistance which enables it to withstand the increased operating current.

Several undesirable features are often exhibited by such insert devices. For example, insertion of the device into the socket is often awkward and typically requires the use of either fingers or tools, such as pliers. At times the installer may neglect to electrically disconnect the lamp, and therefore insertion presents a grave danger of electrical shock.

Present light socket insert devices are often relatively thick. Consequently, they conduct heat relatively slowly and exhibit a smaller than desired drop between high and low temperatures. The initial protective resistance may be lower than desired, and thus premature filament burnout may still occur. Or, the operating resistance of the insert may be higher than desired, thereby unduly restricting current to the bulb filament. Power is thus wasted and the insert device is heated to such a high temperature that it may be suitable for use only in porcelain sockets, which are rated for high wattage bulbs, and not in ordinary metallic light bulb sockets. High operating temperature also poses the hazard of arcing. The mechanical stress and high operating temperatures often experienced by present light socket inserts may lead to cracking and reduced insert life.

The relatively large thickness exhibited by certain of the present insert devices may also force the metal base of the light bulb to extend above the top edge of the light socket. Again, a hazard of shock is presented. Insulating washers and other devices have been provided for wrapping about the exposed base in order to reduce this danger. However, use of such insulating devices may be inconvenient and is often neglected.

SUMMARY OF INVENTION

It is therefore an object of this invention to provide an improved heat-sensitive variable-resistance insert device for use with a light bulb and socket which is relatively durable, inexpensive, and both easy and safe to install and utilize in a wide variety of light sockets.

It is a further object of this invention to provide a heat-sensitive variable-resistance insert device which may be inserted without the use of fingers and/or tools, thereby simplifying insertion and reducing the hazard of electric shock.

It is a further object of this invention to provide a heat-sensitive variable-resistance insert device which is permanently attached to a light bulb so that any attempt to remove it from the bulb results in destruction of the device and prevents its re-use.

It is a further object of this invention to provide a heat-sensitive variable-resistance insert device which provides increased electrical resistance to initial current surges in order to prolong light bulb filament life and decreased operating resistance in order to conserve energy and operate at cooler temperatures.

It is a further object of this invention to provide a heat-sensitive variable-resistance insert device which allows a light bulb to be fully inserted into a light socket, thereby reducing exposure of the base of the bulb above the socket and the hazard of shock created by such exposure, and eliminating the need for insulating devices for guarding against such shock.

It is a further object of this invention to provide a heat-sensitive variable-resistance insert device which reduces arcing.

This invention features a heat-sensitive variable-resistance insert device for use with a light bulb and socket, including a thin heat-sensitive variable-resistance wafer. A perimetrical insulation member surrounds the edge of the wafer and electrically insulates it from the wall of the socket. The wafer has a contact area on one side for engaging the central contact of the socket and on the other side thereof for engaging the central contact of the light bulb. An adhesive paste is provided on that other side of the wafer within the perimetrical member for adhering the device to the base of a light bulb.

In a preferred embodiment, the adhesive paste may be a two-part catalytically activated adhesive with the two parts mounted adjacent each other on the wafer or may be a one-part heat-setting bonding paste. The paste may be viscid and temporarily adhere the wafer to the base of the bulb until the paste fully sets. The paste may be provided in an annular configuration on the wafer to enable the contact of the bulb to extend through the annular hole to contact the wafer. The insulation member may include a plurality of resilient elements on at least one of the surfaces thereof for cushioning the device against the base of a socket. The insulation member may be resilient and may be an elastomer material, or it may be a ceramic material. The wafer may be circular and the insulation member may be annularly disposed thereabout.

DISCLOSURE OF PREFERRED EMBODIMENT

Other objects, features and advantages will occur from the following description of a preferred embodiment and the accompanying drawings, in which.

Figure 5:
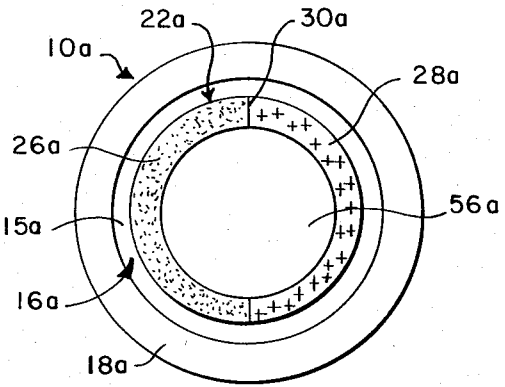
Figure 6:
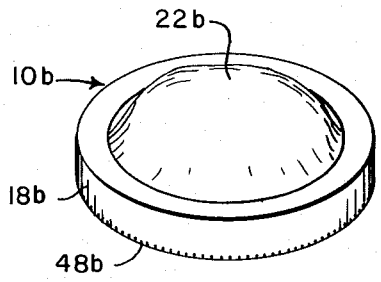
Figure 4C:
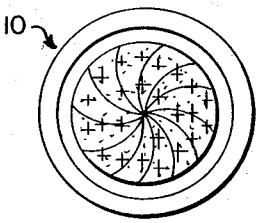
Figure 4B:
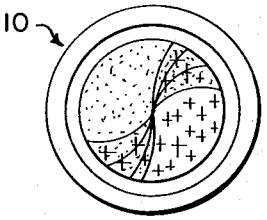
Figure 4A:
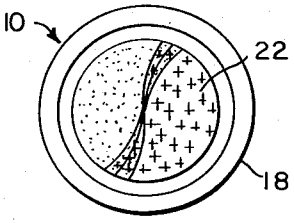

FIGS. 4A, B and C are top plan views of various stages of the mixing of the adhesive paste;

FIG. 5 is a top plan view of an embodiment in which the two-part paste is applied to the wafer in an annular configuration; and FIG. 6 is an axonometric view of an insert device which employs a heat-setting bonding paste.

A heat-sensitive variable-resistance insert device for use with a light bulb and socket according to this invention may be effected using a thin heat-sensitive variable-resistance wafer. The wafer is typically composed of a thermistor ceramic which may include a mixture of manganese dioxide ($MnO_2$) and nickel oxide (NiO). Preferred proportions include 85–90% manganese dioxide and 10–15% nickel oxide.

A perimetrical resilient insulation member surrounds the edge of the wafer and electrically insulates it from the wall of the socket. The insulation member may be composed of a heat-resistant elastomer such as silicone rubber, or a ceramic or other material which is capable of withstanding the operating temperature of the bulb. The insulation member typically has a diameter which is smaller than that of the socket, thereby enabling interference-free insertion and removal of the insert device into and out of the light socket. Typically, the wafer is circular and the insulation member is disposed annularly thereabout. The wafer has a contact area on one side thereof for engaging the central contact of the socket and a contact area on the other side thereof for engaging the central contact of the light bulb.

An adhesive paste is provided on that other side of the wafer within the annular insulation member for adhering the device to the base of a light bulb. This paste may include a two-part catalytically activated adhesive such as is used in auto body repairs and the like, and example of which is Duro DPI Auto Body Filler Putty, manufactured by Loctite Co. The two parts are mounted adjacent each other on the wafer. Such a paste may be viscid and temporarily adhere the wafer to the base of the bulb until the paste is mixed and fully set. Alternatively, the paste may be a single component heat-setting bonding paste. However, because such heat-setting bonding pastes often exhibit a limited shelf life (hardening after one or two years of non-use), the two-part adhesive is preferred. Such two-part pastes, which are often available in the form of two-layer ribbons, typically remain effective for an indefinite period because of a very thin skin which forms between the two layers and prevents mixing and thus setting thereof. In one embodiment, the paste may be applied to the wafer in an annular configuration so that the bulb contact extends through the annular hole to contact the wafer. Where the two-part adhesive is employed, such an annular paste may be divided into two semiannular halves, each comprising one of the two catalytically activated components. The two parts are mixed by the process of screwing the bulb into the socket.

The advantage of the device of this invention lies in the fact that it is inserted into and removed from a light socket without tools or fingers, thereby reducing the hazard of electric shock. Because the paste is viscid, the wafer adheres to the base of the bulb and is inserted into and removed from the socket with the bulb. Further, because the adhesive utilized in this invention typically sets after a period of time (due to the mixing of the two-part catalytically activated adhesive or the heating of the single component paste), the device becomes permanently attached to the base of the light bulb. Thereafter, the thin heat-sensitive wafer tends to readily break if an attempt is made to remove it from the bulb. Thus the wafer cannot be removed from the bulb and replaced by itself in a light socket for re-use.

The wafer provided in this invention is very thin: in standard light bulb and socket applications, a typical wafer is between 0.06 and 0.07 inch in thickness. Due to the thinness of the wafer, and thus its relatively low thermal mass, the device heats up very quickly. The cold resistance may range from approximately 100–200 ohms and the hot resistance may drop to approximately three ohms. The thin wafer also allows the light bulb to be fully inserted (screwed into) the socket. Exposure of the light bulb base above the socket is eliminated, thereby reducing the electrical shock hazard created by such exposure and the need for insulating devices such as washers for wrapping about the exposed base.

A plurality of resilient elements may be provided on at least one of the surfaces of the annular insulation member to enable the member to adapt to the contours of different sockets and accommodate rivets, screws or other parts. Typically, such resilient elements include fingers formed by making a number of crossing radial and annular serrations on the surface faced away from the light bulb.

Figure 1:
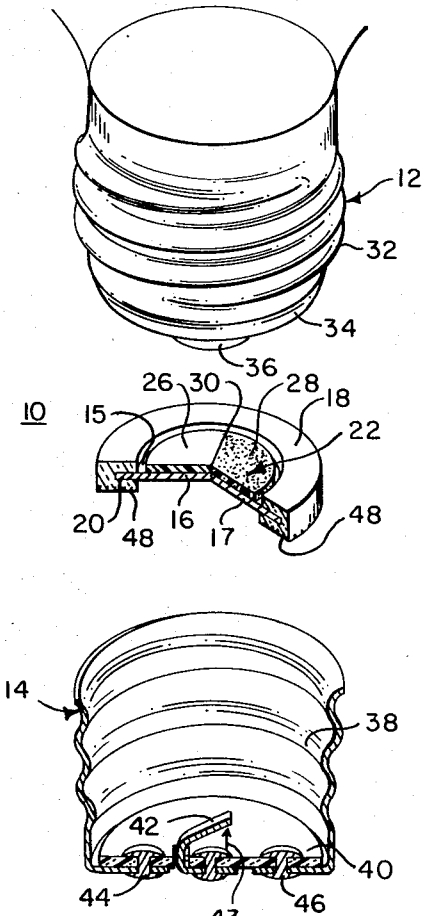
FIG. 1 is an exploded, partly sectional view of an insert device according to this invention, a light bulb to which the device is applied and a socket in which the device is inserted.

There is shown in FIG. 1 a heat-sensitive, variable-resistance insert device 10 which is used with a light bulb 12 and a socket 14 according to this invention. Device 10 includes a thin heat-sensitive variable-resistance circular wafer 16 which exhibits a high resistance when cold and drops to a low resistance as it is heated. Wafer 16 includes a top surface contact area 15 and a bottom surface contact area 17. An annular silicone rubber insulation member 18 surrounds the edge of wafer 16. Member 18 includes a channel 20 for receiving the circumferential edge of wafer 16 and has a diameter which is slightly smaller than that of socket 14. An adhesive paste 22 is mounted on the top surface 15 of wafer 16 within insulation member 18. Paste 22 is a two-part catalytically activated adhesive which includes a first part 26 and a second part 28 separated by a thin skin 30 which prevents mixing of parts 26 and 28, which would cause premature setting of paste 22.

Bulb 12 includes a threaded periphery 32 and a base 34 which has a central bulb contact 36 at the bottom thereof.

Socket 14 includes a threaded inside periphery 38 and a socket base 40. A springy socket contact 42 is mounted in a conventional manner to base 40 and is urged upwardly in the direction of arrow 43. The heads of rivets 44, 46 protrude from socket base 40. Insulation member 18 includes a plurality of resilient elements 48 in the bottom surface thereof. Elements 48 enhance the resilience of member 18 and when device 10 is inserted into socket 14 and member 18 is urged against socket base 40, the elements 48 provide a cushion against rivets 44 and 46.

Figure 2:
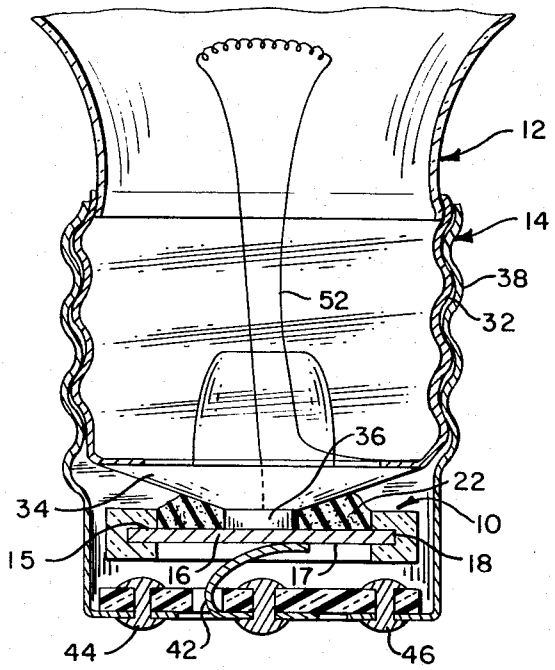
FIG. 2 is an elevational cross-sectional view of the insert device attached to a light bulb and inserted in a socket.

As shown in FIG. 2, bulb 12 is screwed into socket 14 with device 10 attached to the base 34 thereof. Before inserting bulb 10 into socket 14, device 10 is applied to base 34 so that paste 22 comes in contact with base 34. Paste 22 is viscid and temporarily adheres wafer 16 to bulb base 34. As bulb 12 is screwed into socket 14, paste 22 is pressed and twisted so that the two parts of the paste are mixed in a manner more fully described below to enable setting of paste 22. During such insertion, contact 36 is pressed through paste 22 until it comes in contact with the top contact surface 15 of wafer 16. Bulb 12 and the attached device 10 are screwed fully into socket 14 until the bottom surface contact area 17 of device 10 engages the springy central contact 42 of socket 14. Insulation member 18 bears against the tops of rivets 44 and 46 and because of the resilient elements shown in FIG. 1, the insulation member is cushioned against the rivets.

When wafer 16 is cold, it exhibits a relatively high resistance (e.g. from approximately 100–200 ohms). When the light is turned on, incoming current passes from socket contact 42 through wafer 16 to bulb contact 36. The cold high resistance of wafer 16 reduces the initial current surge entering bulb 12. Insulation member 18 insulates wafer 16 from the inside wall 38 of socket 14 and prevents short-circuiting therebetween.

Because of its thin dimension and low thermal mass, wafer 16 heats up relatively quickly and its resistance quickly drops to a low level (e.g. approximately three ohms). Full operating current is allowed to pass through filament 52, which by this point has attained its higher operating resistance. The low level of resistance exhibited by the heated wafer 16 permits the full operating current to pass through the wafer, thereby reducing power dissipation and saving energy. Further, wafer 16 is heated to a lower temperature, thereby reducing arcing, prolonging the life of the insert device, and enabling the device to be utilized in all types of metal sockets. The thinness of wafer 16 also enables bulb 12 to be fully screwed into socket 14 so that the top of base 34 is not exposed about the top of socket 14. The hazard of shock is thereby reduced and the need for an insulation device for surrounding an exposed base is thus eliminated.

Figure 3:
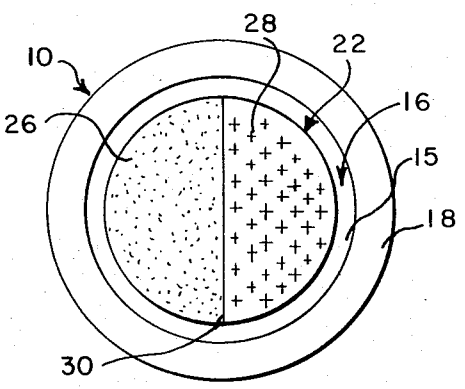
FIG. 3 is a top plan view of the insert device of this invention employing a two-part catalytically activated adhesive paste.

There is shown in FIG. 3 a top view of device 10. Two-part paste 22 is applied to the top coated surface 15 of wafer 16. Skin 30 separates first part 26 and second part 28 and prevents mixing and setting of the parts prior to application of the device 10 to a bulb and insertion of the bulb and device into a light socket.

During insertion of the bulb and device into the light socket, paste 22 is pressed and twisted so that the parts 26 and 28 are mixed in the manner shown in the sequence of FIGS. 4A–4C. The interface, originally a diameter, is twisted into a pinwheel configuration. Following mixture, the two-part adhesive paste sets, thereby permanently bonding device 10 to the base 34 of bulb 12, as shown in FIG. 2.

An alternative manner of applying the two-component paste **22*a* to top surface 15*a* of wafer 16*a* is shown in FIG. 5. Therein, paste 22*a* is applied in an annular configuration comprising first and second parts 26*a* and 28*a*. Each part forms one half of the annular configuration, and a skin 30*a* once again separates the two bonding parts and prevents mixing thereof. Device 10*a* is attached to the base of a light bulb in the same manner as device 10 of FIGS. 1–4. In this embodiment, however, the bulb contact extends through the central hole 56*a* of the annular paste configuration, and thus directly engages the top contact surface 15*a* of wafer 16*a* without pressing through paste 22*a*. When the bulb and device 10*a* are inserted into the socket, the two parts 26*a* and 28*a* are mixed, similarly to the paste 22 of FIGS. 1–4**.

As shown in FIG. 6, a single component paste **22*b* may be applied to the top surface of a variable-resistance wafer. Paste 22*b* includes a heat-setting bonding paste. Device 10*b* is applied to the base of a light bulb so that paste 22*b* engages the base and temporarily adheres device 10*b* to the light bulb. The light bulb and attached device 10*b* are then inserted into a light socket. The device 10*b* operates similarly to the previously described devices 10, 10*a* of this invention. As wafer 16*b* heats up the paste 22*b* sets, thereby permanently bonding device 10*b*** to the base of the light bulb.

In either of the embodiments described herein, the wafer is made sufficiently thin so that once the device has become permanently bonded to the base of the bulb any attempt to remove the device from the base will result in breaking of the wafer, thereby making re-use of the insertion device independently of the bulb impossible.

Other embodiments will occur to those skilled in the art:

What is claimed is:

1. A heat-sensitive variable-resistance insert device for use with a light bulb and socket comprising:

a heat-sensitive variable-resistance wafer;

a perimetrical ceramic insulation member surrounding the edge of said wafer and electrically insulating it from the wall of the socket;

said wafer having a contact area on one side for engaging the central contact of the socket and on the other side for engaging the central contact of the light bulb; and an adhesive paste on said other side of said wafer within said perimetrical member for adhering the device to the base of a light bulb.

2. The insert device of claim 1 in which said adhesive paste is a two-part catalytically activated adhesive with the two parts mounted adjacent each other on said wafer.

3. The insert device of claim 1 in which said paste is viscid and temporarily adheres said wafer to the base of the bulb until the paste fully sets.

4. The insert device of claim 1 in which said paste is a heat-setting bonding paste.

5. The insert device of claim 1 in which said insulation member includes a plurality of resilient elements on at least one side thereof for cushioning said insulation member against the socket base.

6. The insert device of claim 1 in which said paste is provided in an annular configuration on said wafer to enable the contact of said bulb to extend through the central hole thereof to contact said wafer.

7. The insert device of claim 1 in which said wafer is circular and said insulation member is disposed annularly thereabout.

8. A heat-sensitive variable-resistance insert device for use with a light bulb and socket comprising:

a heat-sensitive variable-resistance wafer;

a perimetrical insulation member surrounding the edge of said wafer and electrically insulating it from the wall of the socket:

said wafer having a contact area on one side for engaging the central contact of the socket and on the other side for engaging the central contact of the light bulb; and an adhesive paste on said other side of said wafer within said perimetrical member for adhering the device to the base of a light bulb, said adhesive paste being a two-part catalytically activated adhesive with the two parts mounted adjacent each other on said wafer.

9. The insert device of claim 8 in which said paste is viscid and temporarily adheres said wafer to the base of the bulb until the paste fully sets.

10. The insert device of claim 8 in which said insulation member includes a plurality of resilient elements on at least one side thereof for cushioning said insulation member against the socket base.

11. The insert device of claim 8 in which said paste is provided in an annular configuration on said wafer to enable the contact of said bulb to extend through the central hole thereof to contact said wafer.

12. The insert device of claim 8 in which said insulation member is a resilient material.

13. The insert device of claim 8 in which said insulation member is an elastomeric material.

14. The insert device of claim 8 in which said wafer is circular and said insulation member is disposed annularly thereabout.

15. A heat-sensitive variable-resistance insert device for use with a light bulb and socket comprising:

a heat-sensitive variable-resistance wafer;

a perimetrical insulation member surrounding the edge of said wafer and electrically insulating it from the wall of the socket, said insulation member including a plurality of resilient elements on at least one side thereof for cushioning said insulation member against the socket base;

said wafer having a contact area on one side for engaging the central contact of the socket and on the other side for engaging the central contact of the light bulb; and an adhesive paste on said other side of said wafer within said perimetrical member for adhering the device to the base of a light bulb.

16. The insert device of claim 15 in which said paste is viscid and temporarily adheres said wafer to the base of the bulb until the paste fully sets.

17. The insert device of claim 15 in which said paste is a heat-setting bonding paste.

18. The insert device of claim 15 in which said paste is provided in an annular configuration on said wafer to enable the contact of said bulb to extend through the central hole thereof to contact said wafer.

19. The insert device of claim 15 in which said insulation member is a resilient material.

20. The insert device of claim 15 in which said insulation member is an elastomeric material.

21. The insert device of claim 15 in which said wafer is circular and said insulation member is disposed annularly thereabout.

* * * * *